US009241587B2

(12) United States Patent
Rinderer et al.

(10) Patent No.: US 9,241,587 B2
(45) Date of Patent: Jan. 26, 2016

(54) CONTAINER, IN PARTICULAR A DRINK CONTAINER

(75) Inventors: Matthias Rinderer, Fuschl am See (AT); Catherine Reiter, Strasswalchen (AT); Nathalie Mikhaeel, Salzburg (AT); Peter Huels, Kroev (DE); Roland Concin, Stallehr (AT); Gabriele Weber-Trinkfass, Salzburg (AT)

(73) Assignee: Red Bull GmbH, Fuschl Am See (AT)

( * ) Notice: Subject to any disclaimer, the term of this patent is extended or adjusted under 35 U.S.C. 154(b) by 0 days.

(21) Appl. No.: 13/991,870

(22) PCT Filed: Nov. 23, 2011

(86) PCT No.: PCT/EP2011/005887

§ 371 (c)(1),
(2), (4) Date: Sep. 20, 2013

(87) PCT Pub. No.: WO2012/076119

PCT Pub. Date: Jun. 14, 2012

(65) Prior Publication Data

US 2014/0008378 A1 Jan. 9, 2014

(30) Foreign Application Priority Data

Dec. 6, 2010 (DE) ..... 10 2010 053 431

(51) Int. Cl.
*A47G 19/22* (2006.01)
*B65D 43/02* (2006.01)
(Continued)

(52) U.S. Cl.
CPC ..... *A47G 19/2205* (2013.01); *B65D 43/0212* (2013.01); *B65D 47/0804* (2013.01); *B65D 51/226* (2013.01); *B65D 2251/0018* (2013.01); *B65D 2251/0093* (2013.01)

(58) Field of Classification Search
CPC ..... B65D 43/0212; B65D 51/226; B65D 51/247; B65D 51/22; B65D 51/005; B65D 51/224; B65D 51/227; B65D 51/002; B65D 47/0804; B65D 2251/0018; B65D 2251/0093; A47G 19/2205
USPC ..... 220/703, 255.1, 258.3, 258.4, 258.5; 222/91, 83, 494
See application file for complete search history.

(56) References Cited

U.S. PATENT DOCUMENTS 2,665,024 A * 1/1954 Putz ..... 215/251
3,994,411 A * 11/1976 Elfelt et al. ..... 220/712
(Continued)

FOREIGN PATENT DOCUMENTS

DE 295 15 783 U1 1/1996
EP 0 296 100 A2 12/1988
(Continued)

OTHER PUBLICATIONS

International Search Report dated Feb. 1, 2012, in International Application No. PCT/EP2011/005887, filed Nov. 23, 2011, 3 pages.

*Primary Examiner* — Anthony Stashick
*Assistant Examiner* — James M Van Buskirk
(74) *Attorney, Agent, or Firm* — Seed IP Law Group PLLC

(57) ABSTRACT

A container (1), such as a drink container, comprises a body (2) for accommodating fluids, a bottom (10), a side wall (12), a body opening (28), and a first connecting element (32). A fluid-tight closing unit (30) is connectable to the first connecting element (32) in a fluid-tight manner and has a region where a fluid passage to the body can be provided. A mouthpiece module (24) comprises a mouthpiece (26), a fluid line (34), and a unit (36) for creating a fluid passage to the body in the region. By way of a guiding unit, the fluid line (34) and the unit (36) can be transferred from a distance from the region to a position in which a fluid passage through the closing unit (30) and, by way of the fluid line (34), a connection between the body (2) and the mouthpiece (26), is created.

30 Claims, 5 Drawing Sheets

(51) Int. Cl.

| | |
|---|---|
| ***B65D 51/22*** | (2006.01) |
| ***B65D 47/08*** | (2006.01) |

(56) References Cited

U.S. PATENT DOCUMENTS

| | | | | | |
|---|---|---|---|---|---|
| 4,333,583 | A | * | 6/1982 | Montemarano | 220/712 |
| 4,782,976 | A | | 11/1988 | Kenyon, 2nd. | |
| 4,869,399 | A | | 9/1989 | Dubach | |
| 5,088,614 | A | * | 2/1992 | Dumestre | 220/713 |
| 5,591,468 | A | * | 1/1997 | Stockley et al. | 426/106 |
| 5,769,277 | A | * | 6/1998 | Elliott | 222/153.07 |
| 5,850,951 | A | | 12/1998 | Hayes | |
| 5,853,109 | A | | 12/1998 | Elliott | |
| 6,056,142 | A | * | 5/2000 | Elliott | 220/278 |
| 6,291,037 | B1 | * | 9/2001 | Bakker et al. | 428/34.7 |
| 6,659,308 | B1 | * | 12/2003 | Kelder et al. | 222/83 |
| 2005/0274687 | A1 | | 12/2005 | McCutchan | |
| 2008/0083694 | A1 | * | 4/2008 | Ammann | 215/316 |
| 2009/0101618 | A1 | | 4/2009 | Seelhofer | |

FOREIGN PATENT DOCUMENTS

| | | | |
|---|---|---|---|
| JP | 2005-22757 | A | 1/2005 |
| JP | 2009-154953 | A | 7/2009 |
| JP | 2009-534262 | A | 9/2009 |
| WO | 2007/121601 | A1 | 11/2007 |

* cited by examiner

CONTAINER, IN PARTICULAR A DRINK CONTAINER

FIELD

The present disclosure relates to a container, such as a drink container, and the use of said container for filling, storing, transporting, and consuming fluids, such as beverages.

BACKGROUND

Containers or holders for beverages are currently not only increasingly used for the indirect provision of said beverages, but to a far greater extent, these containers serve directly as beverage containers, i.e., beverages are directly drunk from the container without the aid of a glass or cup. Beverage containers of this nature are, for example, frequently used during car journeys and can be stored in corresponding holders. In particular, one requirement of such holders is that they can be used conveniently and with just one hand. This applies both to the initial opening procedure as well as to the secure and tight re-closure of the container. Many beverages, particularly also soft drinks, must be pasteurized or sterilized in order to comprise a sufficient degree of product purity. This occurs regularly with beverage containers as such. Filling the beverage containers under aseptic conditions is also required in order to guarantee that no germs are present in the beverages offered. These legal requirements regarding foodstuffs frequently present great challenges in relation to the materials used and the production process for beverage containers.

SUMMARY AND INITIAL DISCLOSURE

As a result, various aspects of the present disclosure overcome the disadvantages known from the prior art for beverage containers and, in particular, provide containers that make it possible to prevent the contamination of fluids, such as beverages, during provision and/or filling. In particular, aspects of the present disclosure provide highly pure, e.g., contamination-free fluids, such as beverages, without being reliant, for example, on a pasteurization stage. Furthermore, aspects of the present disclosure provide such containers that could be simply and cost-effectively produced without having to compromise their comfort and safety of use.

In at least one embodiment, disclosed herein is a container, in particular for beverages, that comprises a body for receiving fluids, having a bottom, a first side wall adjoining the bottom, a body opening and a first connecting element for a first fluid-tight closing unit. A first fluid-tight closing unit for the body opening is connected or connectable in a fluid-tight manner with the first connecting element and has at least one first region via which a fluid passage can be provided to the body. At least one mouthpiece module comprises a mouthpiece, a fluid line, and a unit for creating a fluid passage to the body in the area of the first region. The container further includes a guide unit by means of which the fluid line and the unit for creating a fluid passage can be held at a distance from the first region in a first operating mode and which permits a transfer into a second operating mode in which a fluid passage is present in the form of the unit for creating a fluid passage, so that via the fluid line, a connection is achievable or given between the body and the mouthpiece.

In one advantageous embodiment of the container, the first connecting element is a circumferential edge on or in the area of the body opening, in particular, suitable for fluid-tight adhering or bonding of the first fluid-tight closing unit, or a clamping edge for fluid-tight attachment of the first fluid-tight closing unit.

Here, it can furthermore be provided that the first fluid-tight closing unit is, at least in sections, a single- or multi-layer metal and/or plastic film, and/or comprises a plastic lid.

Here, the first region can be a single- or multi-layer plastic and/or metal film that can be penetrated, in particular punched through, when force is applied, in particular in the form of the unit for creating a fluid passage.

Preferably, the first region has at least one, in particular circumferential, perforation or tear line.

Advantageously, the unit for creating a fluid passage is attached in the area or adjacent, i.e., with the generic use above the first region, so that when said unit is activated or moved in the direction of the first region, said region is destroyed or is released to form a fluid passage to the body. The unit for creating a fluid passage is preferably the edge of the fluid line that faces away from the mouthpiece, and can also be described as the punch-through edge. Advantageously, the mouthpiece, the fluid line, and the unit for creating a fluid passage here form an integral, in particular single-piece, component.

The container, according to the present disclosure, can furthermore be designed in such a manner that the guide unit comprises a joint, in particular an integral hinge, and a first connecting piece from the joint to the mouthpiece and/or the fluid line.

Here, it can be provided that the guide unit furthermore comprises at least one second connecting piece from the joint to the first fluid-tight closing unit.

Containers, according to the present disclosure, can furthermore comprise a lid module that at least partially, in particular fully, covers the first fluid-tight closing unit and the mouthpiece module. Here, the mouthpiece module can be affixed to the lid module, which is preferred and is in particular affixed on the inner side and/or on the fluid-tight closing unit.

Additionally, it can be provided that the body of the container, according to the present disclosure, has at least one second connecting element, in particular in the area of the body opening. In a suitable manner, the lid module is connected or connectable to the body by means of the second connecting element, in particular in a reversible manner.

Advantageously, the lid module has at least one lid flap that, when in an unfolded state, releases at least the mouthpiece. The lid flap is advantageously an integral part of the lid module and is connected or connectable to said module via a joint, preferably an integral hinge. The lid flap, can in one embodiment, be surrounded, at least in sections, with perforation and/or tear lines. When the lid flap is activated for the first time, these perforation or tear lines are loosened and enable the lid flap to be unfolded while releasing the mouthpiece. Furthermore, it can be provided that the lid flap is arrestable in the unfolded or folded state, in particular in a reversible manner. It has also been shown to be particularly advantageous when the lid flap has a perforation or tear line with the surrounding lid edge of the lid module, which preferably interacts with the second connecting element. On loosening of this/these line(s), the edge of the lid module then preferably remains in constant interaction with the second connecting element.

The lid flap is preferably designed to be arrestable in the opened and/or closed position. In this manner, the lid flap can be affixed in the opened position in a position in which the user is not impeded while drinking. Here, the lid flap is, in a particularly advantageous embodiment, movably supported by means of a hinge, preferably an integral hinge, as a part of the lid module.

It is advantageous when the lid flap is again arrestable following initial activation, including when in a folded state. For this purpose, an edge or edge area of the lid flap can, for example, be used, which, for example, interacts with the second connecting element, e.g., grips behind it.

Furthermore, it can be provided that the container according to the present disclosure or its mouthpiece module is equipped with a frame, e.g., a feed-in frame for the mouthpiece and, if appropriate, the fluid line. In particular, when the mouthpiece is an integral part of the fluid line, it has been shown to be practical to make the transfer from the first operating mode to the second operating mode within the frame or feed-in frame. Here, it can be provided that the feed-in frame comprises an arresting unit for the mouthpiece in the second operating mode.

The container, according to the present disclosure, can furthermore be characterized by the fact that the second connecting piece and/or the joint is connected or connectable in particular to the side with the feed-in frame which faces away from the joint, and is in particular opposite.

Here, it can be provided that the mouthpiece module is connected or connectable, in particular via the second connecting piece and/or the joint, to the first fluid-tight closing unit and/or, in particular via the feed-in frame, to the lid.

It is also possible that the lid module and/or the body comprise, at least in sections, glass, plastic, ceramic, and/or metal, or are formed from these materials.

It can also be provided that the lid module has at least a third connecting element that is complementary to the second connecting element, wherein by means of the interaction between the second and third connecting element, the body and the lid module are connectable, in particular reversibly.

Containers, according to the present disclosure, can, in an advantageous embodiment, furthermore comprise at least one film, in particular shrink film, which lies at least in sections on the side wall and if appropriate, at least in sections on the lid module, in particular in a shrunken state. Suitable films that surround the side wall and, if appropriate, the lid module at least in sections, and which lie on said wall and thus, if appropriate, hold the body and lid module firmly together, can be made of commonly known plastic materials, for example, polyolefin films such as polyethylene and polypropylene films, or also polystyrol films or films made of styrol copolymers.

In at least one embodiment, the films used have a rubber elastic property profile; as a result of which it is particularly easy to attach the film to the side wall and, if appropriate, to the lid module in such a manner that it lies on it over the full circumference. The film preferably extends around the entire circumference of the container thereby covering the side wall at least in sections. Here, the films are preferably in a tensioned state. The shrink film is preferably shrunk onto at least one section of the body and at least one section of the lid module in such a manner that they cannot move relative to each other or be removed from each other without destroying the shrink film.

Suitable shrink films and methods for their production and application are known to persons skilled in the art. For example, shrink films can be produced from polyolefins such as polyethylene or polypropylene, or from PVC. Advantageously, the film extends in one embodiment, in particular the shrink film, in a state in which it is shrunk onto the container, in the direction of the lid module and at the most, until it just reaches the lid flap.

Containers as described herein are commonly containers for beverages, for example. These can be containers for soft drinks. It is also possible to use the containers described herein for holding, transporting, and drinking coffee, cocoa, or tea drinks, etc.

The present disclosure reveals the surprising fact that in a relatively simple manner, a container, in particular a drink container, can be obtained that during manufacture or filling and closing helps prevent contamination of the fluid, in particular of the beverage. A container according to the present disclosure is also light and reliable to use, i.e., it can be used with one hand, and can in a simple manner also be produced at low cost in mass production without creating a significant amount of rejected goods.

A container according to the present disclosure can be filled without difficulty and under sterile conditions with fluids, for example, beverages such as coffee or cocoa. A long-term pasteurization of the beverage is not required. For this purpose, the sterilized body is filled under aseptic conditions with the fluid, in particular the beverage, via the discharge opening. This discharge opening is then closed or sealed, and the body that is filled in this manner can either be provided with or connected to the lid module in the aseptic filling area or after this area has been left.

DESCRIPTION OF THE DRAWINGS

Further features and advantages of the invention are given in the description below, in which preferred embodiments of the invention are explained as examples with reference to schematic drawings, in which.

DETAILED DESCRIPTION

Figure 1:
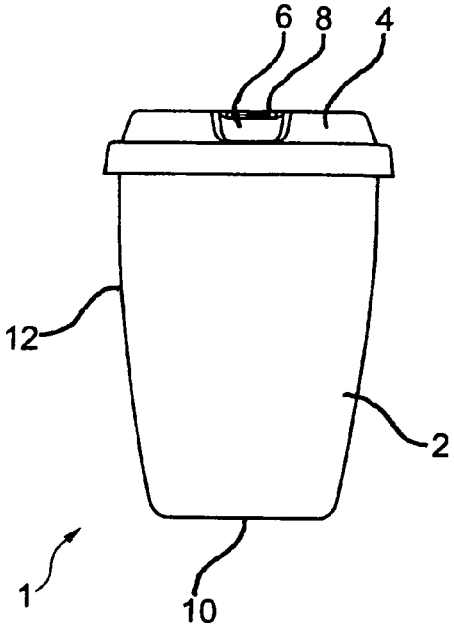
FIG. 1 shows a container according to the present disclosure in a side view.
Figure 2:
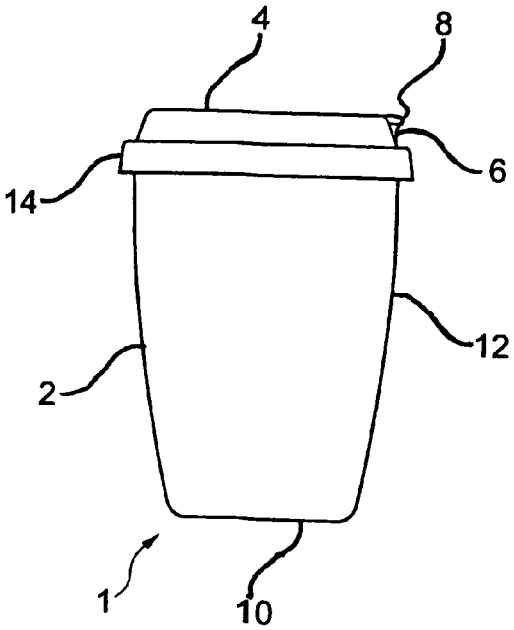
FIG. 2 shows the container according to the present disclosure according to FIG. 1 in a side view turned by 90°.
Figure 3:
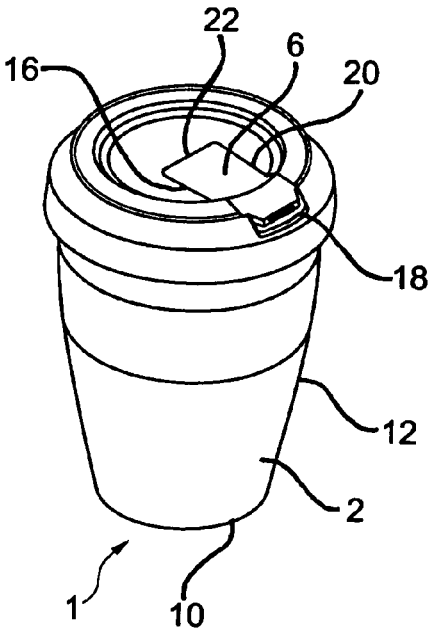
FIG. 3 shows the container according to the present disclosure in a perspective view.

FIG. 1 shows a container 1 according to the present disclosure in a side view with a body 2 and a lid module 4. The lid module 4 is equipped with a lid flap 6 that in the embodiment shown comprises an operating protrusion 8 on the outer edge for easier handling. This can be particularly clearly seen in FIG. 2. The body 2 has a bottom 10 and a side wall 12. The lid module 4 is also equipped with a circumferential edge 14 in the form of a third connecting element. Its function will be explained in greater detail below. As can be seen in FIG. 3, the lid flap 6 is embedded in the lid module 4 by means of tear lines 16, 18, 20. In the embodiment shown, the lid flap 6 is also connected to the lid module 4 via an integral hinge 22.

Figure 4:
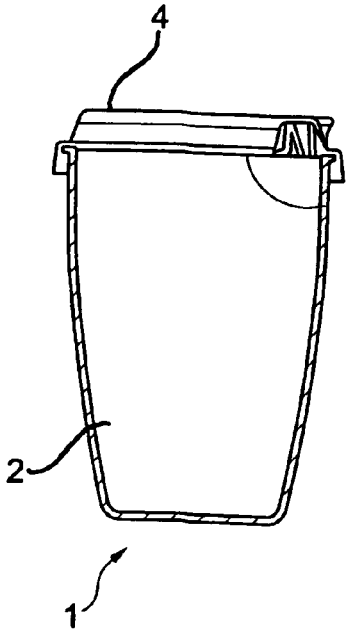
FIG. 4 shows the container according to the present disclosure in a side view.
Figure 5:
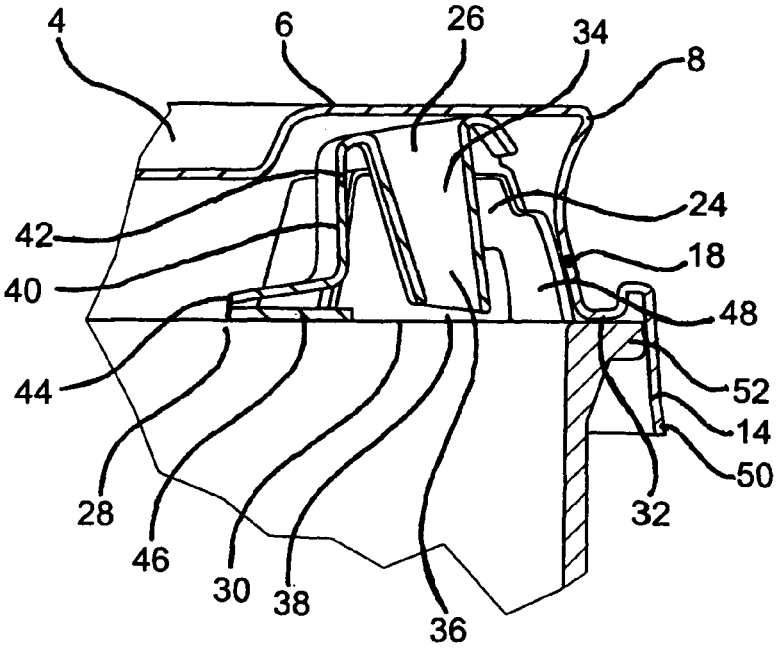
FIG. 5 shows an enlarged portion of a section of the container according to FIG. 4.

As is shown in FIGS. 4 and 5, the lid flap 6 covers the mouthpiece module 24 and in particular the mouthpiece 26. FIGS. 4 and 5 (as do FIGS. 6 and 8) show a fluid line 34 and a unit 36 for creating a fluid passage in the first operating mode, i.e., the unit 36 lies above a first fluid-tight closing unit 30, this being still intact in a region 38. In FIG. 5 in particular, the tear or perforation line 18 can also be seen in the edge area of the lid module 4. FIG. 5 furthermore shows a body opening 28 and the first fluid-tight closing unit 30 in the form of a film tensioned over the body opening 28. The closing unit 30 in the form of the film lies on a circumferential edge 32 of the body 2 that, in the embodiment shown, is the first connecting element of the container according to the present disclosure. In the embodiment shown, a film 30 is on its circumference glued or welded to the circumferential support surface or edge 32 in a fluid-tight manner.

A mouthpiece module 24 comprises, alongside a mouthpiece 26, the fluid line 34 and the unit 36 for creating a fluid passage to the body 2. In the embodiment shown in FIG. 5, this unit 36 is a punch-through edge and is an integral part of the fluid line 34. The unit 36 is located at a distance from or above the first region 38 of the first fluid-tight closing unit 30. The fluid-tight closing element is in the area of the first region designed in such a manner that solely by pushing down the mouthpiece or the fluid line, the film can be penetrated by the punch-through edge to provide a fluid passage to the body.

Furthermore, in the embodiment shown of the container according to the present disclosure, the mouthpiece module 24 has a guide unit 40. In the embodiment shown, the guide unit 40 comprises a first connecting piece 42, which connects a joint 44 to the mouthpiece 26 or the fluid line 34, and a second connecting piece 46, which connects the joint 44 to the first fluid-tight closing unit 30; or in an alternative version shown in FIG. 5, lies on top of said unit without being connected to the film. FIG. 5 shows the first operating mode of the container according to the present disclosure, i.e., the punch-through edge 36 lies above the film 30 and the region 34 is still intact.

Furthermore, in the embodiment shown, the mouthpiece module 24 has a frame 48, also known as a feed-in frame, in which the guide unit 40 together with the mouthpiece 26, fluid line 34, and punch-through edge 36 can be transferred from the first operating mode to a second operating mode. FIG. 5 also shows a circumferential edge 14 of the lid module 4, which interacts as a clamp in the form of a third connecting element 50 with a second connecting element 52 of the body 2 in the form of a circumferential bridge.

Figure 6:
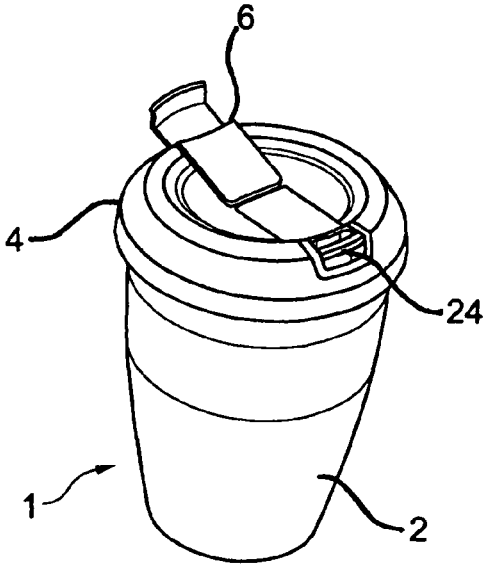
FIG. 6 shows the container according to the present disclosure with an unfolded lid flap in a perspective view.
Figure 7:
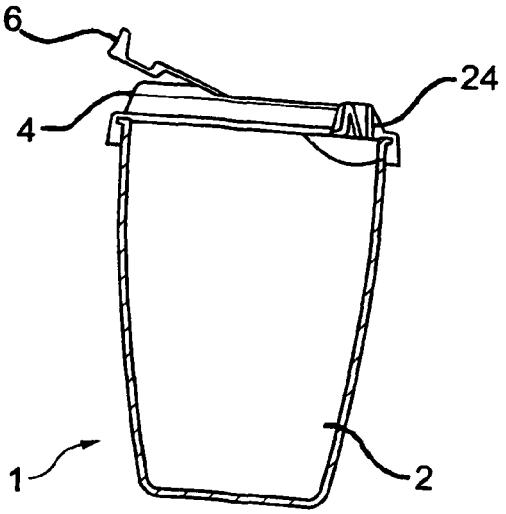
FIG. 7 shows the container according to the present disclosure shown in FIG. 6 in a side profile view.

FIG. 6 shows in a perspective view the container according to the present disclosure 1 with unfolded lid 6. The mouthpiece module 24, as is shown in FIG. 5, still lies in the first operating mode. Accordingly, the sole difference between FIG. 8 and FIG. 5 is that the lid flap 6 is no longer visible in this portion drawing, since it is folded back.

Figure 9:
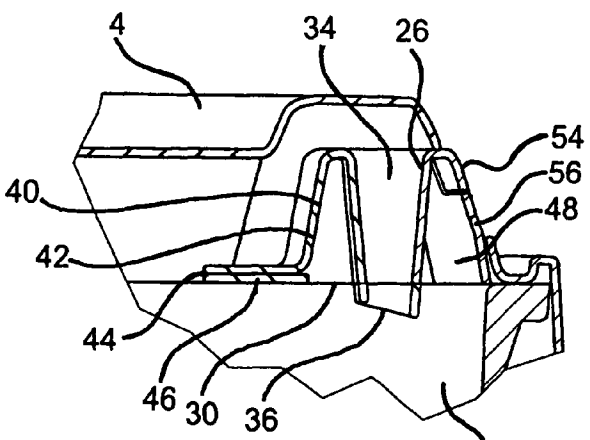
FIG. 9 shows an enlarged view of a section of the container according to the present disclosure in a profile view.
Figure 8:
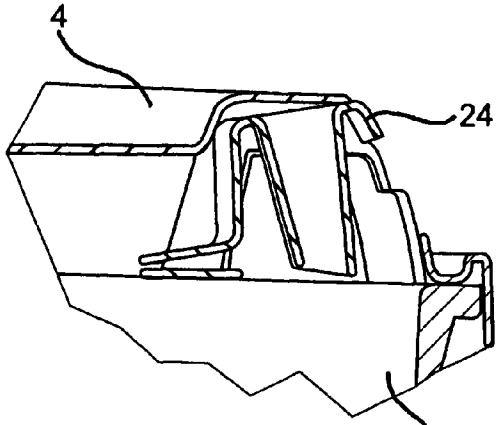
FIG. 8 shows an enlarged view of a section of the container shown in FIG. 7.

FIG. 9 shows a portion of the container according to the present disclosure as shown in FIGS. 5 and 8, but with the difference that the fluid line 34 or the punch-through edge 36 is in the second operating mode. In other words, the mouthpiece 26 has been pushed down together with the fluid line 34 and the punch-through edge 36, thereby penetrating the region 38. In the embodiment shown, the mouthpiece 26 or the front edge 54 of the mouthpiece in this second operating mode lie on a section 56 of the frame 48. In this manner, it is also ensured that fluid from the body 2 can only be removed via the fluid line 34.

During the transfer from the first to the second operating mode, the first connecting piece 42 is guided via the joint 44 in the direction of the fluid-tight closing element 30 or in the direction of the second connecting piece 46, and in the version shown, lies in sections on the latter. Thus, via the guide unit 40 and via the interaction of the edge 54 with the supporting edge 56 of the frame, the position of the mouthpiece 26 in the second operating mode can also be determined.

Excessive pushing of the fluid line into the body does not occur. The guide unit 40 can, for example, be held in the first operating mode, as shown in FIG. 5, by corresponding arresting devices, which will be described in greater detail below. Alternatively or additionally, it is possible that solely due to the design of the joint 44, the punch-through edge 36 is kept at a distance from the region 38. This is achieved, for example, by using integral hinges. Here, the spring elasticity of the integral hinge is sufficient to keep the first connecting piece or the lower arm of said connecting piece 42 at a distance from the second connecting piece 46.

Figure 11:
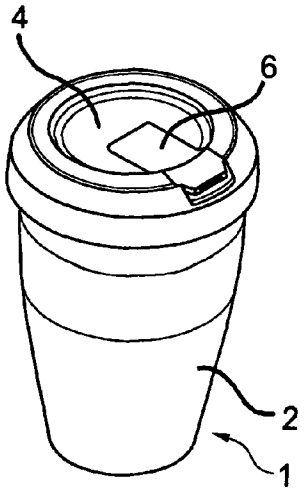
FIG. 11 shows the container according to the present disclosure shown in FIG. 10 with a folded lid flap.
Figure 10:
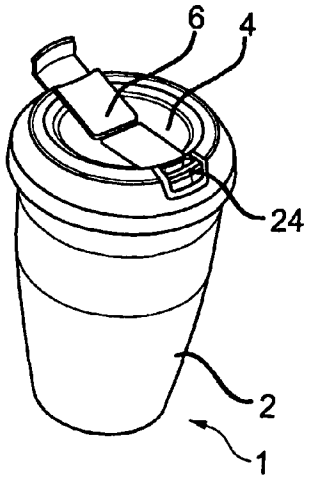
FIG. 10 shows a perspective view of the container according to the present disclosure with an unfolded lid flap.
Figure 12:
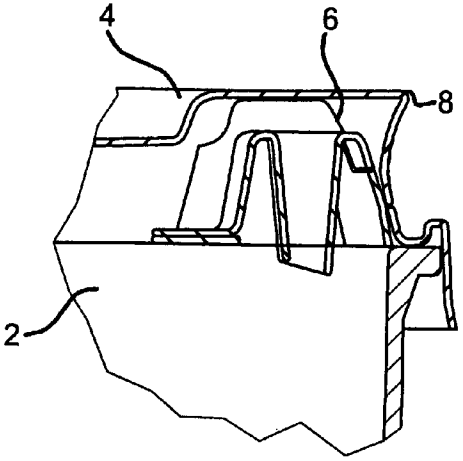
FIG. 12 shows an enlarged view of a portion of the container shown in FIG. 11.

FIG. 11 shows the embodiment according to FIGS. 9 and 10, i.e., the container in the second operating mode with the lid flap 6 folded.

Figure 13:
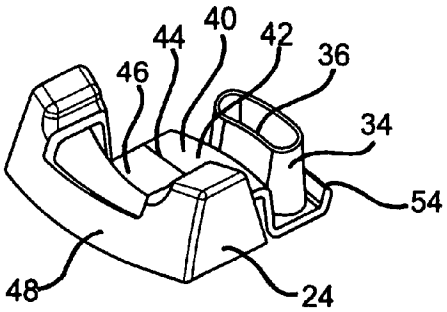
FIG. 13 shows a perspective view of the mouthpiece module of the container according to the present disclosure.
Figure 14:
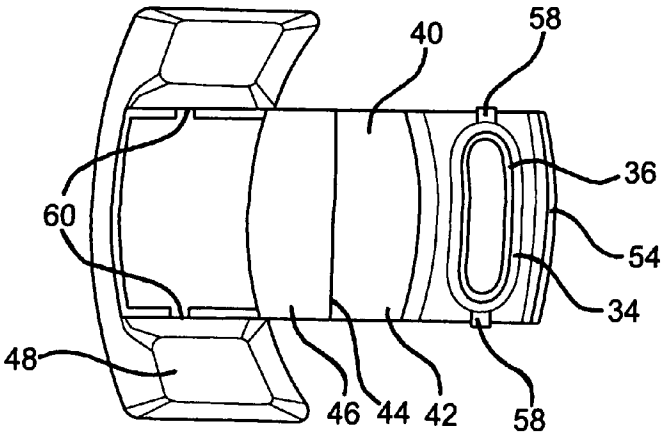
FIG. 14 shows a top view of the mouthpiece module shown in FIG. 13.

FIGS. 13 and 14 show the mouthpiece module 24 of the container according to the present disclosure. In the embodiment shown, the mouthpiece module 24 has the mouthpiece 26, the fluid line 34, and the punch-through edge 36, and also the frame 48 and the guide unit 40. In this embodiment, the guide unit 40 comprises the first connecting piece 42, the joint 44, and the second connecting piece 46. In particular, FIG. 14 shows first and second arresting units 58, 60 with which the mouthpiece is held in the second operating mode. In the embodiment shown, these are latch projections 58 that latch into corresponding slits 60 in the frame 48.

Figure 15:
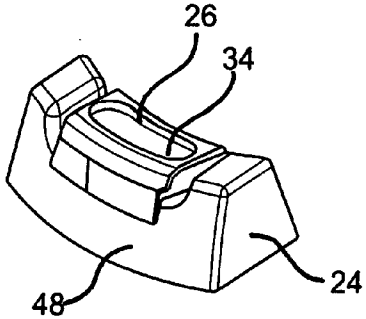
FIG. 15 shows a perspective view of the mouthpiece module.
Figure 16:
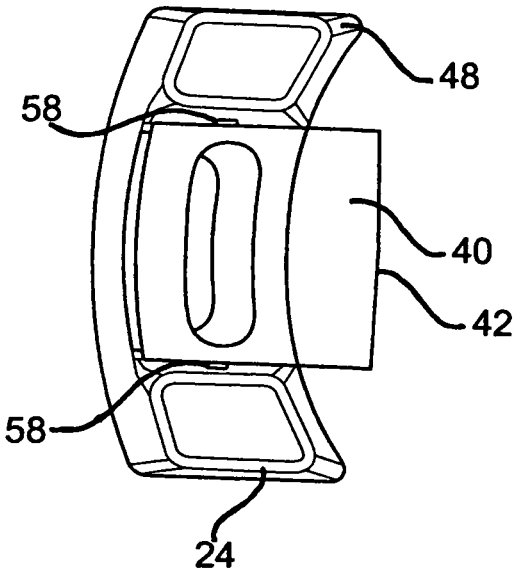
FIG. 16 shows a top view of the mouthpiece module according to FIG. 15.
Figure 17:
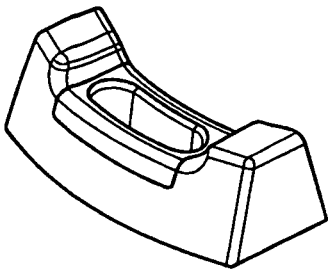
FIG. 17 shows a perspective view of the mouthpiece module.
Figure 18:
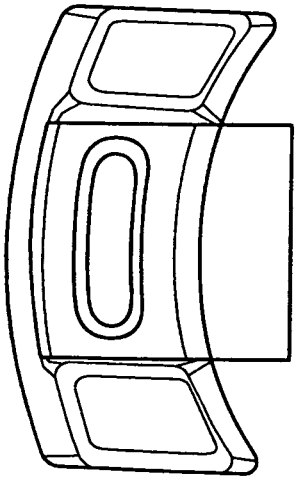
FIG. 18 shows a top view of the mouthpiece module according to FIG. 17.

FIGS. 15 and 16 show the mouthpiece module 24 in the first operating mode, as is present in the containers shown in FIGS. 1-8. In this mode, first and second arresting units 58, 60 do not yet grip each other. By creating a grip between the first and second arresting units 58, 60, the mouthpiece 26, as shown in FIGS. 17 and 18, is held in the second operating mode.

Figure 19:
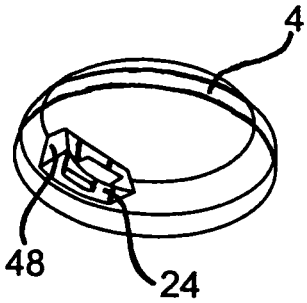
FIG. 19 shows a perspective view of the lid module of the container according to the present disclosure.

FIG. 19 shows a view of a lid module 4 from below. From this, it can be clearly seen that in the embodiment shown, the mouthpiece module 24 is connected via the frame 48 to the inner side of the lid module 4, for example, using adhesion or welding. This construction makes it possible via a simple structure to separate from each other the filling procedure of the body with fluid and the contamination-free sealing by the first closing unit, together with the subsequent attachment of the lid module. With this approach, the intention is not to attach the mouthpiece module 24 onto the first fluid-tight closing unit in a separate step.

Figure 20:
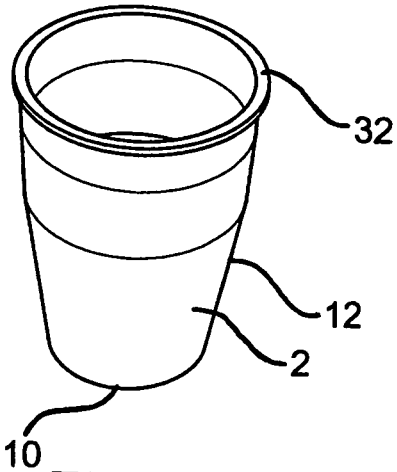
FIG. 20 shows a perspective view of the body of the container according to the present disclosure.

Finally, FIG. 20 shows the body 2 of the container 1 according to the present disclosure with a bottom 10, a side wall 12, a first connecting element 32 in the form of a circumferential support surface for the fluid-tight attachment of the first fluid-tight closing unit, and the second connecting element 52 in the form of a bridge or circumference edge or protrusion which extends outwards from the side wall 12, onto which the edge 14 of the lid 4 can be clamped.

The features of the present description, in the claims, and in the drawings can be essential both individually and in any combination required for the realization of the invention in its different embodiments.

The invention claimed is:

1. A beverage container, comprising:

a body for receiving fluids, wherein the body has a bottom, a first side wall adjoining the bottom, a body opening, and a first connecting element;

a fluid-tight closing unit for the body opening that is connected or connectable in a fluid-tight manner with the first connecting element and that has a region where a fluid passage to the body can be provided;

a mouthpiece module comprising a mouthpiece, a fluid line, and a unit for creating a fluid passage to the body in the region; and a guide unit by way of which the fluid line and the unit for creating a fluid passage can be held at a distance from the region in a first operating mode and that permits a transfer into a second operating mode in which a fluid passage is present in the unit for creating a fluid passage to the body so that via the fluid line, a connection is achievable between the body and the mouthpiece, wherein the guide unit comprises a hinge and a first connecting piece from the hinge to the mouthpiece and/or the fluid line, wherein the guide unit further comprises a second connecting piece from the hinge to the fluid-tight closing unit, wherein the first connecting piece and the second connecting piece are connected to each other in a pivoting manner via the hinge, and wherein, in the first operating mode, the hinge has a spring elasticity that keeps the first connecting piece at a distance from the second connecting piece.

2. The container according to claim 1, wherein the first connecting element is a circumferential edge on or in the area of the body opening for fluid-tight adhering or bonding of the fluid-tight closing unit.

3. The container according to claim 1, wherein the fluid-tight closing unit is, at least in sections, a single- or multi-layer metal and/or plastic film.

4. The container according to claim 1, wherein the region where a fluid passage to the body can be provided includes a single- or multi-layer plastic and/or metal film that can be penetrated when force is applied by the unit for creating a fluid passage.

5. The container according to claim 4, wherein the region has a circumferential perforation or tear line.

6. The container according to claim 1, wherein the mouthpiece, the fluid line, and the unit for creating a fluid passage form an integral single-piece component.

7. The container according to claim 1, wherein the unit for creating a fluid passage is an opening edge of the fluid line that faces away from the mouthpiece.

8. The container according to claim 1, wherein the hinge is an integral hinge.

9. The container according to claim 1, further comprising a lid module that at least partially covers the fluid-tight closing unit and the mouthpiece module.

10. The container according to claim 9, wherein the body has a second circumferential connecting element in the area of the body opening.

11. The container according to claim 10, wherein the lid module is connected or connectable to the body by way of the second circumferential connecting element.

12. The container according to claim 9, wherein the lid module has a lid flap, which, when in an unfolded state, releases at least the mouthpiece.

13. The container according to claim 12, wherein the lid flap is an integral part of the lid module and is connected or connectable to said lid module via a joint.

14. The container according to claim 12, wherein the lid flap is surrounded at least in sections with perforation and/or tear lines.

15. The container according to claim 12, wherein the lid flap is arrestable in the unfolded state or a folded state in a reversible manner.

16. The container according to claim 13, wherein the mouthpiece module further comprises a frame for the mouthpiece and the fluid line.

17. The container according to claim 16, wherein the frame comprises an arresting unit for the mouthpiece in the second operating mode.

18. The container according to claim 16, further comprising a second connecting element that is connected or connectable to a side with the frame that faces away from the joint.

19. The container according to claim 18, wherein the mouthpiece module is connected or connectable via the second connecting element and/or the joint to the fluid-tight closing unit.

20. The container according to claim 9, wherein the lid module and/or the body comprise at least in sections glass, plastic, ceramic, and/or metal.

21. The container according to claim 18, wherein the lid module has a third connecting element that is complementary to the second connecting element, wherein the body and the lid module are connectable by way of interaction between the second and third connecting elements.

22. The container according to claim 1, further comprising a film that lies at least in sections on the side wall and at least in sections on the lid module.

23. A method of using the beverage container according to claim 1, wherein the method comprises storing and transporting fluids in the beverage container.

24. The container according to claim 1, wherein the first connecting element is a clamping edge on or in the area of the body opening for fluid-tight attachment of the fluid-tight closing unit.

25. The container according to claim 1, wherein the fluid-tight closing unit comprises a plastic lid.

26. The container according to claim 22, wherein the film is a shrink film that lies at least in sections on the side wall and at least in sections on the lid module in a shrunken state.

27. The container according to claim 1, wherein the fluid-tight closing unit lies upon a circumferential edge of the body.

28. The container according to claim 1, wherein the second connecting piece is connected only to the fluid-tight closing unit.

29. The container according to claim 28, wherein the region where a fluid passage to the body can be provided separates the second connecting piece from the first side wall.

30. A beverage container, comprising:

a body for receiving fluids, wherein the body has a bottom, a first side wall adjoining the bottom, a body opening, and a first connecting element;

a fluid-tight closing unit for the body opening that is connected or connectable in a fluid-tight manner with the first connecting element and has a region where a fluid passage to the body can be provided;

a mouthpiece module comprising a mouthpiece, a fluid line, and a unit for creating a fluid passage to the body in the region; and a guide unit by way of which the fluid line and the unit for creating a fluid passage can be held at a distance from the region in a first operating mode and that permits a transfer into a second operating mode in which a fluid passage is present in the unit for creating a fluid passage to the body so that via the fluid line, a connection is achievable between the body and the mouthpiece, wherein the guide unit comprises a hinge and a first connecting piece from the hinge to the mouthpiece and/or the fluid line, wherein the guide unit further comprises a second connecting piece from the hinge to the fluid-tight closing unit, and wherein the second connecting piece connects the hinge to the fluid-tight closing unit or lies on top to the fluid-tight closing unit.

* * * * *